US009470233B2

(12) United States Patent
Tamaki

(10) Patent No.: US 9,470,233 B2
(45) Date of Patent: Oct. 18, 2016

(54) CENTRIFUGAL COMPRESSOR AND MANUFACTURING METHOD THEREOF

(75) Inventor: Hideaki Tamaki, Tokyo (JP)

(73) Assignee: IHI Corporation, Tokyo (JP)

( * ) Notice: Subject to any disclaimer, the term of this patent is extended or adjusted under 35 U.S.C. 154(b) by 760 days.

(21) Appl. No.: 13/979,444

(22) PCT Filed: Jan. 18, 2012

(86) PCT No.: PCT/JP2012/050961

§ 371 (c)(1),
(2), (4) Date: Jul. 12, 2013

(87) PCT Pub. No.: WO2012/102146

PCT Pub. Date: Aug. 2, 2012

(65) Prior Publication Data

US 2013/0302155 A1 Nov. 14, 2013

(30) Foreign Application Priority Data

Jan. 24, 2011 (JP) ..... 2011-011925

(51) Int. Cl.
*F04D 17/08* (2006.01)
*F04D 29/42* (2006.01)
(Continued)

(52) U.S. Cl.
CPC ..... *F04D 17/08* (2013.01); *F04D 27/023* (2013.01); *F04D 29/4213* (2013.01); *F04D 29/441* (2013.01); *F04D 29/685* (2013.01); *F05D 2250/51* (2013.01); *Y10T 29/49243* (2015.01)

(58) Field of Classification Search
CPC .... F04D 17/08; F04D 27/023; F04D 29/685; F04D 29/441; F04D 29/4213; F05D 2250/51
USPC ..... 415/206
See application file for complete search history.

(56) References Cited

U.S. PATENT DOCUMENTS 4,990,053 A * 2/1991 Rohne ..... F04D 27/0215 415/143
6,290,458 B1 9/2001 Irie et al.
(Continued)

FOREIGN PATENT DOCUMENTS

CN 1542289 A 11/2004
CN 101365883 A 2/2009
(Continued)

OTHER PUBLICATIONS

Office Action issued Feb. 27, 2015 in Japanese Patent Application No. 2011-011925 (with English language translation).
(Continued)

*Primary Examiner* — Igor Kershteyn
*Assistant Examiner* — Aaron R Eastman
(74) *Attorney, Agent, or Firm* — Oblon, McClelland, Maier & Neustadt, L.L.P.

(57) ABSTRACT

A centrifugal compressor includes an impeller, a casing, an impeller housing portion, an inlet port, an annular flow passage provided around the impeller, a discharge port communicated with the annular flow passage, an annular chamber provided around the inlet port, a downstream slot communicating a downstream end of the annular chamber with the impeller housing portion, and an upstream slot communicating an upstream end of the annular chamber with the inlet port. The downstream slot draws a one-cycle curved line pulsating in an axial direction of the inlet port. A most upstream point of the downstream slot is located at an upstream end portion of impeller blades of the impeller when seen along a direction perpendicular to a rotary shaft of the impeller. According to the centrifugal compressor, it becomes possible to expand its operating range by improving a surging restriction effect brought by more effective casing treatment.

8 Claims, 6 Drawing Sheets

(51) Int. Cl.

| | |
|---|---|
| ***F04D 29/44*** | (2006.01) |
| ***F04D 29/68*** | (2006.01) |
| ***F04D 27/02*** | (2006.01) |

(56) References Cited

U.S. PATENT DOCUMENTS

| | | | |
|---|---|---|---|
| 7,229,243 | B2 | 6/2007 | Nikpour et al. |
| 2005/0008484 | A1 | 1/2005 | Nikpour et al. |
| 2010/0014956 | A1 | 1/2010 | Guemmer |

FOREIGN PATENT DOCUMENTS

| | | | |
|---|---|---|---|
| CN | 101749279 | A | 6/2010 |
| EP | 1 134 427 | | 9/2001 |
| JP | 5 509142 | | 12/1993 |
| JP | 2001 263296 | | 9/2001 |
| JP | 2004 332734 | | 11/2004 |
| JP | 2007-127109 | A | 5/2007 |
| JP | 2008 255996 | | 10/2008 |
| JP | 2012-230795 | A | 11/2012 |

OTHER PUBLICATIONS

Extended European Search Report issued Nov. 5, 2014 in Patent Application No. 12738991.4.

International Search Report Issued Apr. 17, 2012 in PCT/JP12/050961 filed Jan. 18, 2012.

Combined Office Action and Search Report issued Apr. 17, 2015 in Chinese Patent Application No. 201280005960.6 (with English language translation).

* cited by examiner

CENTRIFUGAL COMPRESSOR AND MANUFACTURING METHOD THEREOF

TECHNICAL FIELD

The present invention relates to a centrifugal compressor for raising pressure of compressible fluid, and a manufacturing method thereof.

BACKGROUND ART

Surging due to backflow of fluid when flow volume is small restricts an operating range of a centrifugal compressor for raising pressure of compressible fluid. Since surging makes a centrifugal compressor inoperable, an operating range of a centrifugal compressor can be expanded by restricting surging. A Patent Document 1 listed below discloses casing treatment as one of methods for restricting surging.

A centrifugal compressor includes an impeller that rotates at high speed, and a casing that houses the impeller while forming a scroll flow passage around the impeller. In the casing treatment disclosed in the Patent Document 1, a slot is formed along an entire circumference of a wall surface of the casing near an upstream end of the impeller, and the slot is communicated with a flow passage on an upstream side from the impeller. According to this, fluid partially recirculates from a high-pressure portion locally generated in the impeller when flow volume is small to the upstream side from the impeller, so that surging is restricted.

PRIOR ART DOCUMENT

Patent Document

Patent Document 1: Japanese Patent Application Laid-Open No. 2004-332734

SUMMARY OF INVENTION

Technical Problem

Although a surging restriction effect can be brought by the above-explained casing treatment, it is desired to expand an operating range of a centrifugal compressor by restricting surging further.

An object of the present invention is to provide a centrifugal compressor that can expand its operating range by improving a surging restriction effect brought by more effective casing treatment, and to provide a manufacturing method thereof.

Technical Solution

A first aspect of the present invention provides a centrifugal compressor that includes an impeller and a casing, the compressor comprising: an impeller housing portion provided in the casing to house the impeller; an inlet port provided in the casing coaxially with the impeller housed in the impeller housing portion; an annular flow passage provided in the casing so as to surround the impeller housed in the impeller housing portion; a discharge port provided in the casing so as to communicate with the annular flow passage; an annular chamber provided around the inlet port; a downstream slot that communicates a downstream end of the annular chamber with the impeller housing portion; and an upstream slot that communicates an upstream end of the annular chamber with the inlet port, wherein the downstream slot draws a one-cycle curved line that pulsates in an axial direction of the inlet port with a predetermined amplitude, and a most upstream point on a center line of the downstream slot is located at an upstream end portion of impeller blades of the impeller when seen along a direction perpendicular to a direction of a rotary shaft of the impeller.

According to the first aspect, it becomes possible to expand an operating range by improving a surging restriction effect.

Here, it is especially preferable that the casing includes a tongue that is formed at a boundary between the discharge port and the annular flow passage, and, when seen along the direction of the rotary shaft of the impeller and a straight line passing through the rotary shaft and an end of the tongue is defined as a reference 0° and an opposite direction to a flow direction in the annular flow passage is defined as positive, a most downstream point on the center line of the downstream slot is located within a range −150° to +30° about the rotary shaft.

In addition, it is preferable that an inner wall cylinder body that is detachable from the casing is provided within the inlet port, the annular chamber is formed between the inner wall cylinder body and the casing, an upstream end of the annular chamber is opened to an inside of the inlet port, the downstream slot is formed on the inner wall cylinder body, and the inner wall cylinder body is configured to be fixed to the casing with capability of changing a rotational position thereof about the rotary shaft by a predetermined pitch.

A second aspect of the present invention provides A manufacturing method of a centrifugal compressor that includes an impeller and a casing, the centrifugal compressor comprising: an impeller housing portion provided in the casing to house the impeller; an inlet port provided in the casing coaxially with the impeller housed in the impeller housing portion; an annular flow passage provided in the casing so as to surround the impeller housed in the impeller housing portion; a discharge port provided in the casing so as to communicate with the annular flow passage; an annular chamber provided around the inlet port; a downstream slot that communicates a downstream end of the annular chamber with the impeller housing portion; and an upstream slot that communicates an upstream end of the annular chamber with the inlet port, wherein the downstream slot draws a one-cycle curved line that pulsates in an axial direction of the inlet port with a predetermined amplitude, and a most upstream point on a center line of the downstream slot is located at an upstream end portion of impeller blades of the impeller when seen along a direction perpendicular to a direction of a rotary shaft of the impeller, an inner wall cylinder body that is detachable from the casing is provided within the inlet port, the annular chamber is formed between the inner wall cylinder body and the casing, an upstream end of the inner wall cylinder body is communicated with the inlet port, the downstream slot is formed on the inner wall cylinder body, and the inner wall cylinder body is configured to be fixed to the casing with capability of changing a rotational position thereof about the rotary shaft by a predetermined pitch, and the manufacturing method comprising: determining an optimum position of the downstream slot to the casing while changing the rotational position of the inner wall cylinder body, and making the casing by setting a fixed position of the inner wall cylinder body to the determined optimum position.

According to the second aspect, it becomes possible to set an adequate position of the casing easily, and, therefore, it becomes possible to manufacture a centrifugal compressor that can expand its operating range by improving a surging restriction effect.

DESCRIPTION OF EMBODIMENTS

Hereinafter, a centrifugal compressor according to an embodiment will be explained with reference to the drawings.

Figure 1:
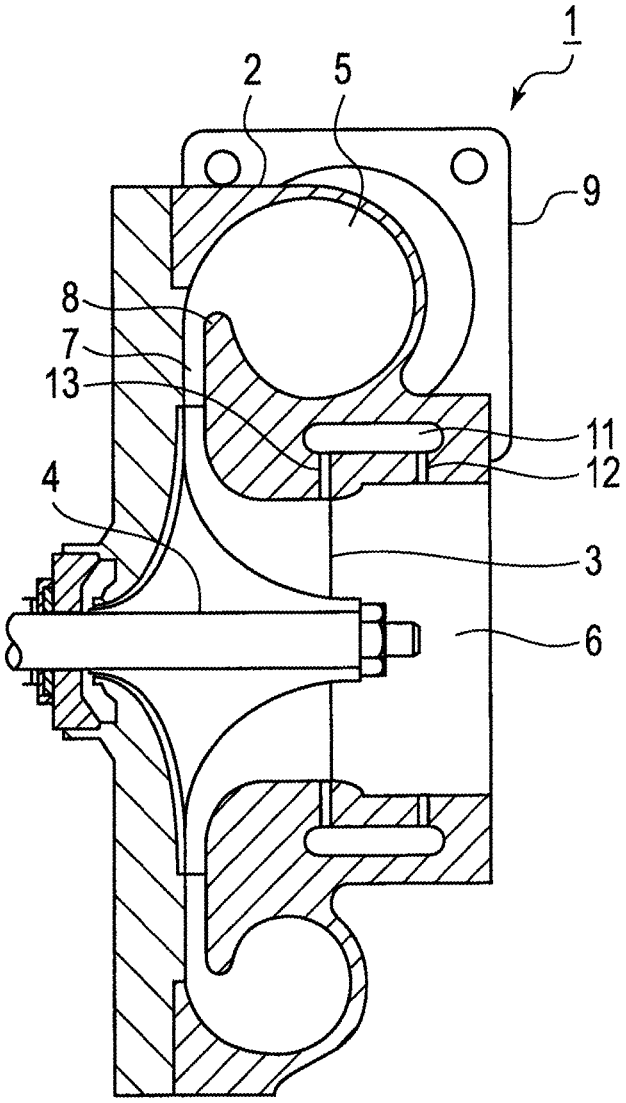
FIG. 1 It is a cross-sectional view of a centrifugal compressor according to an embodiment.

As shown in FIG. 1, the centrifugal compressor 1 includes a casing 2 and an impeller 3 housed in the casing 2. A rotary shaft 4 of the impeller 3 is rotatably supported by a bearing housing (not shown). The impeller 3 is fixed to one end of the rotary shaft 4. Note that a turbine (not shown) is coupled to another end of the rotary shaft 4, for example.

In the casing 2, an annular flow passage 5 is formed around the impeller 3. A discharge port 9 for discharging pressure-raised compressible fluid (e.g. compressed air) is communicated with a required position of the annular flow passage 5. An inlet port 6 is opened at the center of the casing 2 coaxially with the impeller 3.

A diffuser 7 communicating with the annular flow passage 5 is formed around the impeller 3. The diffuser 7 is an annular channel that communicates a space housing the impeller 3 with the annular flow passage 5 in the casing 2. A boundary wall 8 is formed between the annular flow passage 5 and the diffuser 7.

The turbine is rotated by exhaust gas from an engine (not shown), so that the impeller 3 coaxially provided with the turbine is rotated via the rotary shaft 4. Air for combustion is inhaled from the inlet port 6 due to the rotation of the impeller 3. The inhaled air is compressed by passing through the impeller 3 and the diffuser 7, and then flows into the annular flow passage 5. The compressed air is discharged from the annular flow passage 5 through the discharge port 9.

Next, casing treatment will be explained.

An annular chamber 11 is formed in the inside of the casing 2 coaxially with the inlet port 6. The annular chamber 11 has a flat cross section along an axial direction of the inlet port 6. An upper end (a right end in FIG. 1) of the annular chamber 11 locates upstream further from an upstream end(s of fins) of the impeller 3, and a downstream end locates downstream from the upstream end of the impeller 3.

An upstream portion of the annular chamber 11 is communicated with the inlet port 6 by an upstream slot 12. On the other hand, a downstream portion of the annular chamber 11 communicates with a downstream slot 13, and the downstream slot 13 is opened on a wall surface near the upstream end of the impeller 3. The upstream slot 12 and the downstream slot 13 may be formed with ribs provided in its consecutive annular slot at predetermined intervals. Alternatively, the upstream slot 12 and the downstream slot 13 may be formed by opening holes elongated along the circumferential direction at predetermined intervals. Alternatively, the upstream slot 12 and the downstream slot 13 may be formed by opening circular holes at predetermined pitches.

Figure 2:
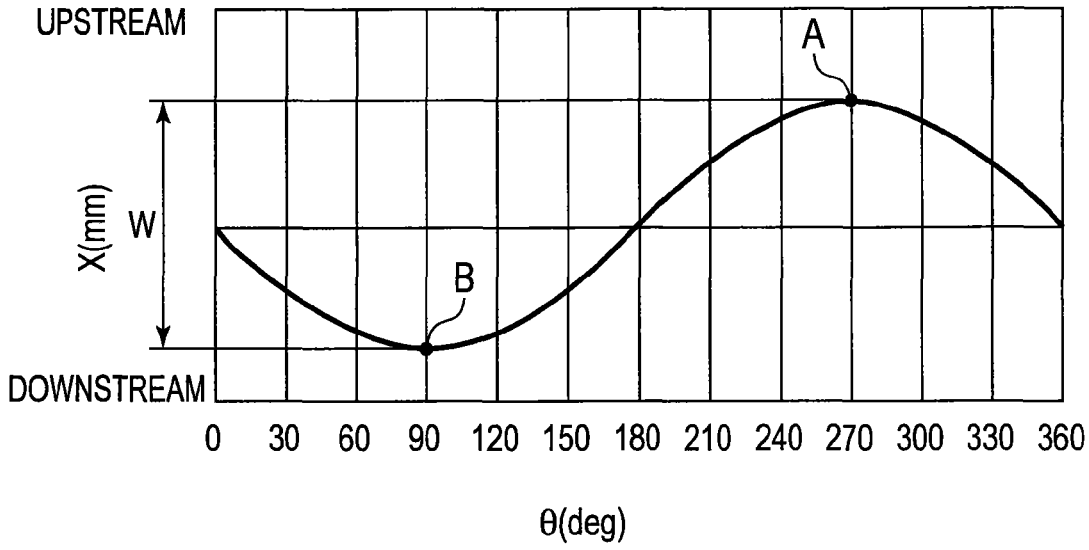
FIG. 2 It shows a graph for explaining a shape of a downstream slot by casing treatment in the embodiment.

If developing the downstream slot 13 extending along the circumferential direction on a flat surface, the downstream slot 13 is shown as a one-cycle curved line that pulsates in the axial direction with a predetermined amplitude (W/2 [mm]) as shown in FIG. 2. The curved line is a sine curve, for example, but not limited to a sine curve.

Since the upstream end of the impeller 3 and the inlet port 6 are communicated with each other through the downstream slot 13, the annular chamber 11 and the upstream slot 12, fluid partially recirculates from a high-pressure portion locally generated in the impeller 3 when flow volume is small to an upstream side from the impeller 3, so that surging is restricted.

A shape of the casing 2, especially a shape of the annular flow passage 5, is not made axisymmetrically. Therefore, pressure distribution in the inside of the annular flow passage 5 is not constant but varies, along the circumferential direction. Further, pressure distribution along a circumferential edge of the impeller 3 also varies similarly. The pressure distribution in the inside of the annular flow passage 5 propagates into the impeller 3 through the diffuser 7. Therefore, the high-pressure portion locally generated in the impeller 3 is not always generated at the same location, and considered to move according to the pressure distribution of the annular flow passage 5. The curved line drawn by the downstream slot 13 reflects the movement of the high-pressure portion locally generated in the impeller 3 to effectively recirculate fluid at the high-pressure portion. As a result, surging is restricted effectively.

Next, the downstream slot 13 will be explained in detail.

In the present embodiment, the downstream slot 13 draws a sine curve as shown in FIG. 2. Note that the curved line shown in FIG. 2 indicates a locus of a center line of the downstream slot 13. Here, a maximum diameter of the impeller 3 is D=144.2 [mm] and a slot width of the downstream slot 13 is d=3 [mm], so that d/D=0.02. A point A in FIG. 2 indicates the most upstream point of the downstream slot 13, a point B indicates the most downstream point of the downstream slot 13, and W/2 indicates the amplitude (W=Amplitude×2).

Figure 3:
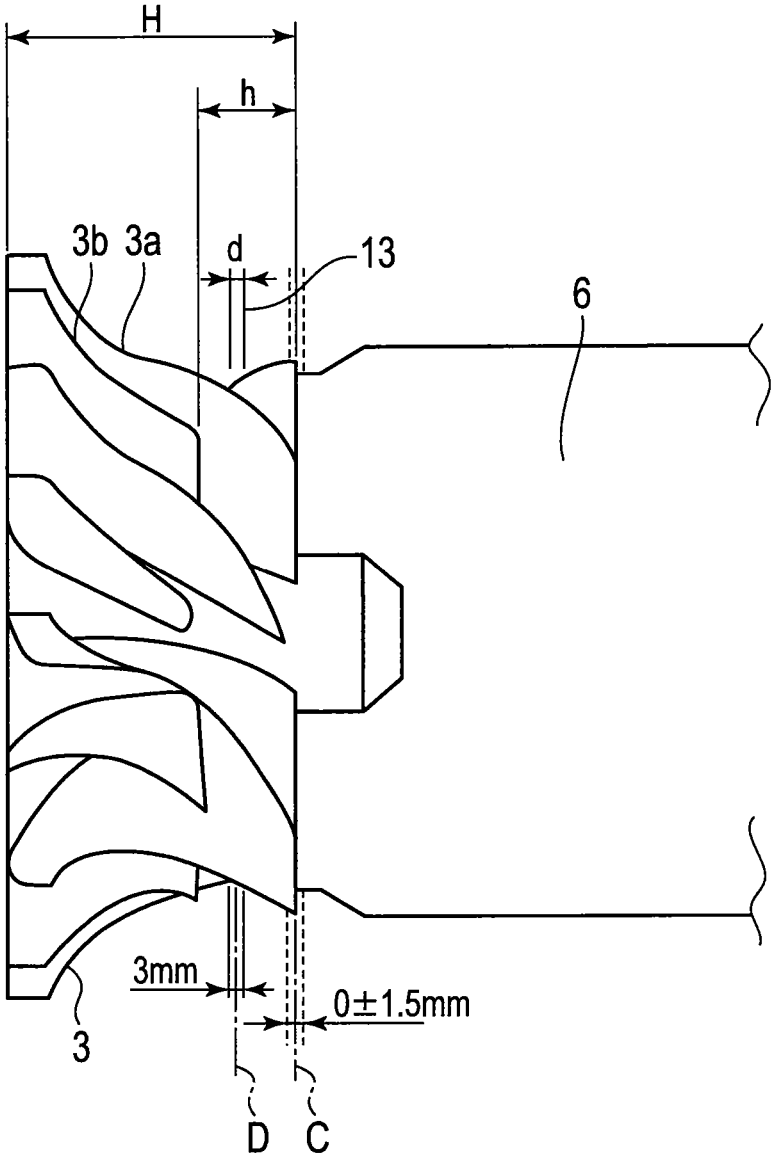
FIG. 3 It is a side view showing relations of an upstream slot, the downstream slot and an impeller in the embodiment.

As shown in FIG. 3, the most upstream point A exists on a line C (center line of the downstream slot 13), and the most downstream point B exists on a line D (center line of the downstream slot 13). Namely, the downstream slot 13 pulsates between the line C and the line D. Note that the downstream slot 13 that draws a cyclic curved line is drawn as straight lines as a matter of practical convenience. The line C (and the point A on the line C) locates within a range (=an upstream end portion) of ±d/2 (d/2=1.5 mm) in upstream and downstream directions to the upstream end of impeller blades 3*a* as a center. Note that an optimum position of the line C (most upstream point A) within the above-explained range ±d/2 is set through calculations or experimentations because it may change according to a shape of the casing 2, a characteristic of the impeller 3 and so on.

In a case where the impeller 3 is provided with small blades 3*b*, the allowable most downstream position of the line D is an upstream end of the small blades 3*b*. In the present embodiment, the upstream end of the small blades 3*b* locates at a position of h [mm] downstream from the upstream end of the impeller blades 3*a*. If the impeller 3 is provided with no small blades 3*b*, the allowable most downstream position of the line D is almost ½ of a height H of the impeller blades 3*a* (almost a middle of the impeller blades 3*a* along the axial direction). Note that the reason of setting the allowable most downstream position of the line D at almost ½ of the height H of the impeller blades 3*a* is that it may bring no surging restriction effect and reduction of compression efficiency to set the line D (i.e. the most downstream point B) downstream from the above allowable most downstream position and it makes practically no sense.

Next, a circumferential position of the downstream slot 13 (i.e. a position of the most upstream point A or the most downstream point B) will be explained with reference to the FIG. 4. Note that a rotational center of the impeller 3 and an original point of X-Y coordinate are located at a same point in FIG. 4. An axis that is parallel to a center axis of the discharge port 9 and passes over the rotational center of the impeller 3 (the original point) is an X-axis, and an axis that passes over the rotational center of the impeller 3 (the original point) and is perpendicular to the X-axis is a Y-axis. The circumferential position of the downstream slot 13 is indicated by an angle about the original point when the x-axis is defined 0° (counter-clockwise direction [direction toward upstream of flow] is +). In addition, a tongue 15 formed at a boundary between the discharge port 9 and the annular flow passage 5 is also shown in FIG. 4.

Figure 4:
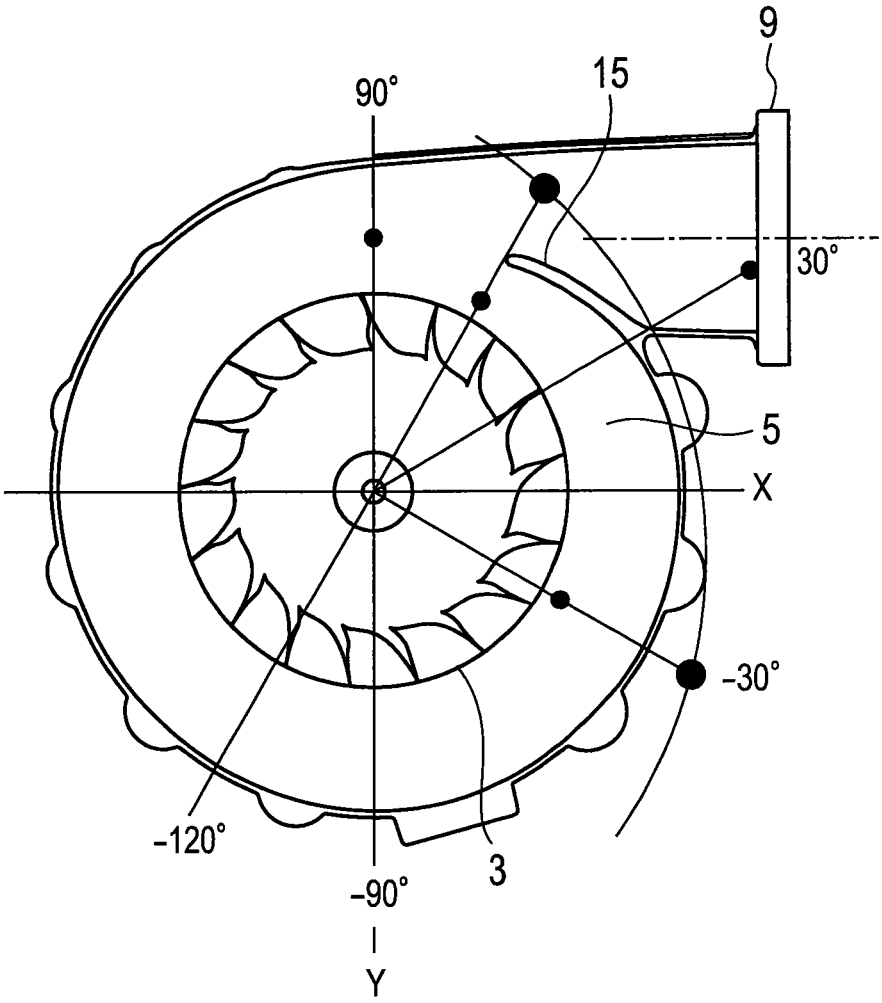
FIG. 4 It is a side view showing positional relation of a casing and the most downstream point of the downstream slot in the embodiment.

An end of the tongue 15 locates at a position +60°, and a surging restriction effect can be brought when the most downstream point B of the downstream slot 13 locates within a range +90° to −90° including 0° (a half right area in FIG. 4; a range +30° to −150° from the end of the tongue 15 [+60° to the X-axis as a reference 0° ]). Note that, although it will be explained later, experimentation results indicate that the best surging restriction effect can be brought when the most downstream point B locates at a position of the end of the tongue 15. The most downstream point B is determined according to the pressure distribution along the circumferential edge of the impeller 3, and an optimum position of the most downstream point B is not always the position of the end of the tongue 15 because the pressure distribution may vary according to a shape, a characteristic or the like of the impeller 3.

However, the optimum position of the most downstream point B is obtained near the end of the tongue 15 (e.g. within a range±30° from the end of the tongue 15 [+30° to +90° to the X-axis as a reference 0°]). Therefore, the position of the most downstream point B is set within a range +30° to −150° from the end of the tongue 15 [+90° to −90° to the X-axis as a reference 0°], preferably within a range±30° [+30° to +90° to the X-axis as a reference 0°].

Figure 5:
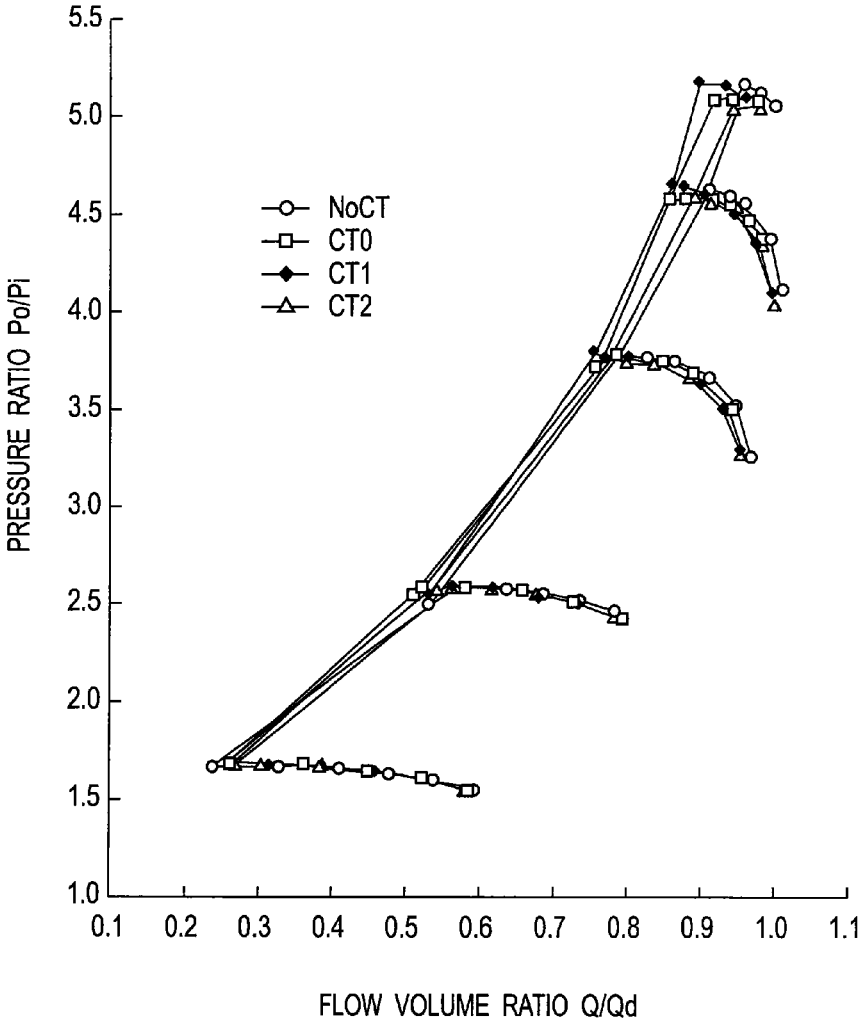
FIG. 5 It is a graph showing performance lines of centrifugal compressors.

FIG. 5 shows operation characteristics of casing treatments. In a graph shown in FIG. 5, its horizontal axis indicates flow volume ratio (Q/Qd: Q is discharge flow volume, and Qd is design flow volume), and its vertical axis shows pressure ratio (Po/Pi: Po is fluid pressure at outlet port, and Pi is fluid pressure at inlet port).

Within a left side area of each performance line, surging occurs and thereby a centrifugal compressor becomes inoperable. Namely, each performance line indicates surging a threshold limit value. In FIG. 5, NoCT is a performance line of a centrifugal compressor without casing treatment (i.e. the annular chamber 11, the upstream slot 12 and the downstream slot 13 are not provided). CT0 is a performance line of a prior-art centrifugal compressor in which the downstream slot 13 does not draw a curved line (draws a strait line when developing the downstream slot 13) and the upstream slot 12 is located upstream from the upstream end of the impeller 3. CT1 is a performance line of the centrifugal compressor in the present embodiment (the downstream slot 13 draws a sine curve when developed [hereinafter, referred as sine curve treatment] and the most downstream point B of the downstream slot 13 locates at the end of the tongue 15). CT2 is a performance line of a centrifugal compressor in which a sine curve treatment is adopted but the most downstream point B of the downstream slot 13 locates at a position −120° to the X-axis as a reference 0° (i.e. an exact opposite position to the tongue 15).

It is obvious from the FIG. 5 that any of the three examples (CT0 to CT2) with casing treatment can obtain a surging restriction effect better than that in a centrifugal compressor without casing treatment (NoCT).

In addition, in relation to the centrifugal compressor with casing treatment (CT0), the centrifugal compressors with sine curve treatment (CT1, CT2) bring a case where a surging restriction effect increases and a case where a surging restriction effect decreases. In the case of the centrifugal compressor in the present embodiment (CT1: the most downstream point B locates at a position of the end of the tongue 15), its surging restriction effect increases. In the case of the centrifugal compressor (CT2: the most downstream point B locates at an exactly opposite position to the end of the tongue 15), its surging restriction effect decreases. Therefore, it is obvious that an optimum position for increasing a surging restriction effect exists in a case where the downstream slot 13 is pulsated with one cycle along the circumferential direction.

In relation to the prior-art centrifugal compressor (CT0) with casing treatment, a position of the most downstream point B that increases a surging restriction effect is a range +30° to −150° from the end of the tongue 15 [±90° to the X-axis as a reference 0° (including 0°)], preferably a range±30° [+30° to +90° to the X-axis as a reference 0°].

A surging restriction effect can be increases in relation to prior-art casing treatment by setting a position of the most downstream point B within a range±30° from the end of the tongue 15, but it is preferable to determine an optimum position of the most downstream point B through calculations in view of a shape of a casing, a shape and a characteristic of an impeller 3, a capacity of a centrifugal compressor and so on in order to set the optimum position of the most downstream point B within the above range±30°.

Next, a centrifugal compressor capable of easily setting the most downstream point B at its optimum position without calculations and a manufacturing method thereof will be explained with reference to FIG. 6 and FIG. 7.

Figure 6:
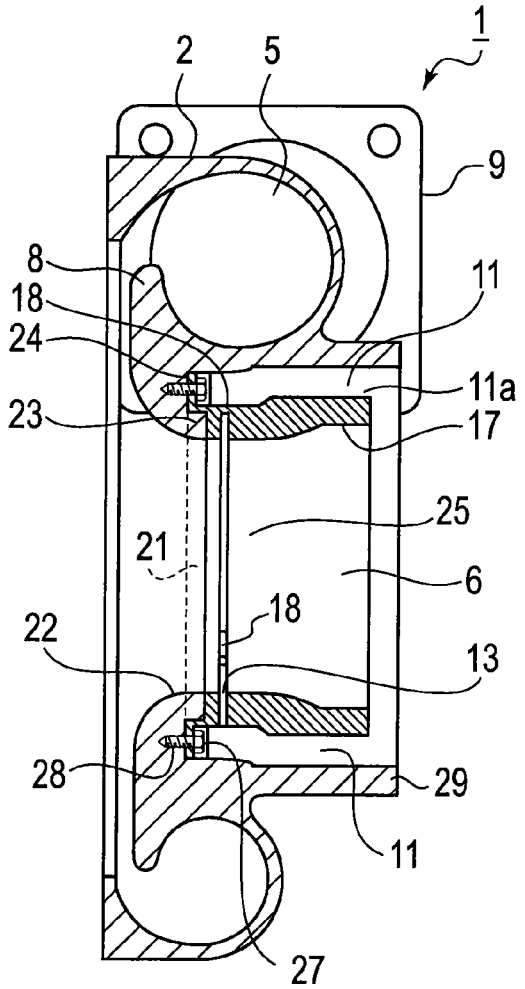
FIG. 6 It is a cross-sectional view showing a configurational example of casing treatment.
Figure 7:
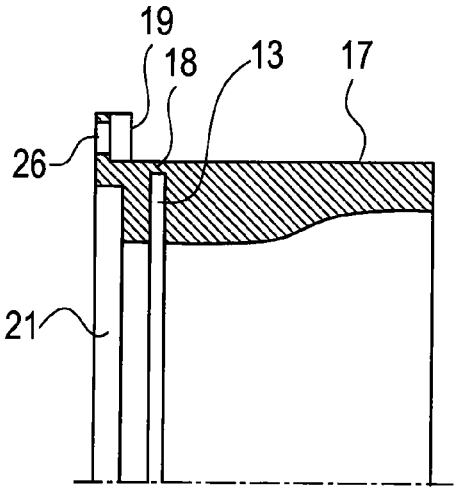
FIG. 7 It is a partially enlarged cross-sectional view of an inner wall cylinder body shown in FIG. 6.

As shown in FIG. 6, an inner wall cylinder body 17 is provided within the inlet port 6. The annular chamber 11 is formed between the inner wall cylinder body 17 and the casing 2. An upstream end of the annular chamber 11 is opened to the inside of the inlet port as an annular upstream-end opening 11*a*. The annular chamber 11 communicates with the inlet port 6 through the upstream-end opening 11*a* formed by an inlet ring 29 of the inlet port 6 and an upstream end of the inner wall cylinder body 17. Here, the upstream-end opening 11*a* corresponds to the upstream slot 12.

A downstream end of the inner wall cylinder body 17 forms an upstream section of an impeller housing portion 25 in which the impeller 3 is housed. The downstream slot 13 is formed at the downstream end of the inner wall cylinder body 17. The downstream slot 13 passes through the inner wall cylinder body 17 in its radius directions to communicate the annular chamber 11 with the impeller housing portion 25. In addition, as shown in FIG. 7, ribs 18 are provided in the downstream slot 13 at predetermined intervals along the circumferential direction. If developing the downstream slot 13 extending along the circumferential direction on a flat surface, the downstream slot 13 is shown as a one-cycle curved line that pulsates in the axial direction with a predetermined amplitude (here, a sine curve).

A flange 19 is formed on an outer circumferential surface at the downstream end of the inner wall cylinder body 17. A fitting female portion 21 is formed on an inner circumferential surface at the downstream end of the inner wall cylinder body 17. In addition, an annular seat 22 is formed at an inner edge of the casing 2. A fitting male portion 23 protruding upstream is formed at an inner circumferential edge of the annular seat 22. An annular depressed portion 24 is formed around the fitting male portion 23. The fitting male portion 23 and the fitting female portion 21 are fit with each other, and the flange 19 is housed in the annular depressed portion 24. The inner wall cylinder body 17 and the casing 2 (the fitting male portion 23) are jointed almost-airtightly, and fixed with each other by bolts to ensure airtightness. Note that an O ring may be set between the inner wall cylinder body 17 and the casing 2 (the circumference of the fitting male portion 23) to ensure airtightness.

Non-penetrating screw holes 28 are formed in the annular depressed portion 24 at predetermined intervals (e.g. divided into twelve equal segments) along its circumferential direction. On the other hand, bolt holes 26 are formed on the flange 19 at predetermined intervals (e.g. divided into at least three equal segments) along its circumferential direction. Note that, in view of positional adjustment and balancing of fixing strength of the inner wall cylinder body 17, it is preferable that the bolt holes 26 are penetrated at positions for dividing into three or four equal segments along the circumferential direction. The bolt holes 26 and the screw holes 28 are aligned when the fitting female portion 21 and the fitting male portion 23 are fit with each other, and then bolts are attached to fix the inner wall cylinder body 17 onto the casing 2.

Since the screw holes 28 are formed on the annular depressed portion 24 to divide it into twelve equal segments (i.e. with 30° pitches) and the bolt holes 26 are formed on the flange 19 at arbitrary positions among the positions dividing into twelve equal segments, a rotational position of the inner wall cylinder body 17 can be changed by each 30° pitch in relation to the casing 2.

Since the screw holes 28 are formed on the annular depressed portion 24 to divide it into twelve equal segments (i.e. with 30° pitches) and the bolt holes 26 are formed on the flange 19 at arbitrary positions among the positions dividing into twelve equal segments, a rotational position of the inner wall cylinder body 17 can be changed by each 30° pitch in relation to the casing 2.

If the above-explained pitch for forming the bolt holes 26 is set to 15°, the rotational position of the inner wall cylinder body 17, i.e. the position of the most downstream point B can be changed by each 15° pitch in relation to the casing 2.

As explained above, an optimum position of the most downstream point B of the downstream slot 13 can be easily determined by a simple configuration.

In a case of small-quantity production, it is possible to determine an optimum position of the inner wall cylinder body 17 and then manufacture products in each of which the inner wall cylinder body 17 has been fixed at the optimum position on the casing 2. Alternatively, in a case of large-quantity production, the casing and the inner wall cylinder body 17 are formed integrally based on obtained data.

Note that, although the downstream slot 13 draws a sine curve in the above embodiment, it may be a slot that draws a one-cycle curved line pulsating in the axial direction of the inlet port 6 with a predetermined amplitude.

The invention claimed is:

1. A centrifugal compressor that includes an impeller and a casing, the compressor comprising:

an impeller housing portion provided in the casing to house the impeller;

an inlet port provided in the casing coaxially with the impeller housed in the impeller housing portion;

an annular flow passage provided in the casing so as to surround the impeller housed in the impeller housing portion;

a discharge port provided in the casing so as to communicate with the annular flow passage;

an annular chamber provided around the inlet port;

a downstream slot that communicates a downstream end of the annular chamber with the impeller housing portion; and an upstream slot that communicates an upstream end of the annular chamber with the inlet port, wherein the axial position of the downstream slot varies along the circumference of the inlet port according to a curved line with one single cycle around the circumference and with a predetermined amplitude, the centrifugal compressor being characterised by a most upstream point on a center line of the downstream slot being located at an upstream end portion of impeller blades of the impeller when seen along a direction perpendicular to a direction of a rotary shaft of the impeller.

2. The centrifugal compressor according to claim 1, wherein the casing includes a tongue that is formed at a boundary between the discharge port and the annular flow passage, and, when seen along the direction of the rotary shaft of the impeller and a straight line passing through the rotary shaft and an end of the tongue is defined as a reference 0° and an opposite direction to a flow direction in the annular flow passage is defined as positive, a most downstream point on the center line of the downstream slot is located within a range −150° to +30° about the rotary shaft.

3. The centrifugal compressor according to claim 2, wherein the most downstream point is located within a range ±30° about the rotary shaft.

4. The centrifugal compressor according to claim 2, wherein the most downstream point is located upstream from a ½ position of a height of the impeller blades along the direction of the rotary shaft.

5. The centrifugal compressor according to claim 2, wherein the impeller further includes small blades whose height is less than a height of the impeller blades.

6. The centrifugal compressor according to claim 1, wherein an inner wall cylinder body that is detachable from the casing is provided within the inlet port, the annular chamber is formed between the inner wall cylinder body and the casing, an upstream end of the annular chamber is opened to an inside of the inlet port, the downstream slot is formed on the inner wall cylinder body, and the inner wall cylinder body is configured to be fixed to the casing with capability of changing a rotational position thereof about the rotary shaft by a predetermined pitch.

7. The centrifugal compressor according to claim 1, wherein the upstream end portion where the most upstream point is located is a range ±1.5 mm from the upstream end of the impeller blades.

8. A manufacturing method of a centrifugal compressor that includes an impeller and a casing, the centrifugal compressor comprising:

an impeller housing portion provided in the casing to house the impeller;

an inlet port provided in the casing coaxially with the impeller housed in the impeller housing portion;

an annular flow passage provided in the casing so as to surround the impeller housed in the impeller housing portion;

a discharge port provided in the casing so as to communicate with the annular flow passage;

an annular chamber provided around the inlet port;

a downstream slot that communicates a downstream end of the annular chamber with the impeller housing portion; and an upstream slot that communicates an upstream end of the annular chamber with the inlet port, wherein the axial position of the downstream slot varies along the circumference of the inlet port according to a curved line with one single cycle around the circumference and with a predetermined amplitude, the centrifugal compressor being characterised by a most upstream point on a center line of the downstream slot being located at an upstream end portion of impeller blades of the impeller when seen along a direction perpendicular to a direction of a rotary shaft of the impeller, an inner wall cylinder body that is detachable from the casing is provided within the inlet port, the annular chamber is formed between the inner wall cylinder body and the casing, an upstream end of the annular chamber is communicated with the inlet port, the downstream slot is formed on the inner wall cylinder body, and the inner wall cylinder body is configured to be fixed to the casing with capability of changing a rotational position thereof about the rotary shaft by a predetermined pitch, and the manufacturing method comprising:

determining an optimum position of the downstream slot to the casing while changing the rotational position of the inner wall cylinder body, and making the casing by setting a fixed position of the inner wall cylinder body to the determined optimum position.

* * * * *